United States Patent [19]

Hodler et al.

[11] 3,931,832

[45] Jan. 13, 1976

[54] TIMING DEVICE FOR PNEUMATIC CONTROL SYSTEMS

[76] Inventors: Karl Hodler, 119 Brunishalde, CH 5611 Buttikon AG, Switzerland; Erich Walter, 124 Harksheider Weg, D 2085 Quickborn, Germany

[22] Filed: June 27, 1974

(Under Rule 47)

[21] Appl. No.: 483,518

Related U.S. Application Data

[63] Continuation of Ser. No. 344,064, March 23, 1973, abandoned, which is a continuation of Ser. No. 112,596, Feb. 4, 1971, abandoned, which is a continuation-in-part of Ser. No. 774,824, Nov. 12, 1968, abandoned.

[30] Foreign Application Priority Data

Dec. 8, 1967 Germany ..... 1650450

[52] U.S. Cl. ..... 137/624.11; 251/28; 251/63.4; 251/64; 251/73; 137/625.61

[51] Int. Cl.[2] ..... F15B 21/10

[58] Field of Search ..... 58/42; 137/624.11, 624.14; 251/28, 62, 63.4, 64, 73

[56] References Cited

UNITED STATES PATENTS

| | | | |
|---|---|---|---|
| 736,958 | 8/1903 | Girod | 58/42 |
| 3,326,418 | 6/1967 | Kropp | 137/624.14 X |

*Primary Examiner*—Alan Cohan
*Assistant Examiner*—Gerald A. Michalsky
*Attorney, Agent, or Firm*—Brisebois & Kruger

[57] ABSTRACT

This invention relates to pneumatic control systems, particularly to a timing device for the same, wherein a control device is maintained at a constant speed by means of a balance wheel or flywheel, whose kinetic energy furnishes a pneumatic signal and which mechanically shifts a valve to pass on the pneumatic signal. The shifting of the valve is adjustable.

6 Claims, 6 Drawing Figures

Inventor

By

Inventor

By

*Inventor*

*By*

*Attorney*

TIMING DEVICE FOR PNEUMATIC CONTROL SYSTEMS

This is a continuation, of application Ser. No. 344,064, filed Mar. 23, 1973, now abandoned which application was itself a continuation of application SN 112,596, filed Feb. 4, 1971, now abandoned which was in turn a continuation-in-part of application SN 774,824 filed Nov. 12, 1968, now abandoned the priority of which applications is hereby claimed.

In pneumatic control systems, the problem often arises that a pneumatic signal for initiating an operation of any desired kind, for example, for actuating a valve, is not to be effective in operating the valve immediately upon receipt of the signal but only after a certain period of time providing a delay. In most cases, the delay time must, moreover, be adjustable. Conversely, there is also the problem of allowing a pneumatic signal to exist only for a predetermined time.

In certain known timing devices for pneumatic control systems, the time control is effected by incorporating a throttling non-return valve into the control mechanism. In this way, the pressure can only build up slowly according to the amount of throttling and a pneumatically actuated device arranged to be fed therethrough receives the pressure required to trigger it in delayed manner. With this arrangement, only short delay times can be obtained. For longer delay times, a storing device is incorporated behind the throttle, by which means delay times of up to about 2 minutes may be obtained. The consistency of the reproducibility of the delay time which can be obtained with such arrangements is, however, not high, especially when it is a question of relatively long times.

In order to obtain a more exact observance of the time delay in known devices, a high-pressure relief valve is therefore also built-in between the storing device and the device to be controlled. The effect of the differing friction ratios of distributing slide valves embodied in the valve is thereby overcome, but here, too, the consistency of the reproducibility is limited.

Delays may also be obtained with cylinder type timers. In this case, a cylinder member moving outwardly in a delayed manner directly actuates the device to be controlled. If a single-acting cylinder is used with spring release, the speed of the induction air is regulated. In the case of double-acting cylinders, the speed can be regulated by the exhaust air or the induction air, if operation is carried out with an adjustable counterpressure. The greatest accuracy may be obtained if operation is carried out with a hydraulic condenser, that is to say, a dash-pot of the operating cylinder. Here, too, there are limitations with respect to delay time and the consistency in the reproducibility thereof.

If longer and more exact delay times are more especially required, operation can no longer be effected with the known systems described above. One course which is then sometimes employed is to initiate the delay by means of electrical timing mechanisms. The incoming pneumatic signal is passed by an electric switch which switches the electrically operating timing mechanism on and after a certain time has passed actuates an electromagnetic valve. However, such a timing control is very expensive.

In another device which is on the market and is very expensive, pneumatic pulses of constant frequency are generated which effect a pneumatic pre-selection counter, which counts backwards from a pre-selected number and actuates a valve when it reaches the zero position. The pneumatic pulses are sent through a mechanical oscillation system (balance wheel), which has a deflector plate for pulse control and which is driven directly by an outflowing air stream.

It is an object of the invention to avoid or minimise the disadvantages of the known pneumatically operating timers employing a storing device or speed-regulated operating cylinders, and to provide a simpler construction than in the case of timers with electrical time control or control by means of pneumatic pulses.

The invention consists in a timing device for pneumatic control systems, wherein a control device is moved at a constant speed under the control of a balance wheel or flywheel, whose kinetic energy is furnished by a pneumatic signal and wherein the amount of a movement of the control device is adjustable to adjust the time delay between the receipt of the pneumatic signal and the passing on of said pneumatic signal by the operation of a valve.

According to one aspect of the present invention there is provided a timing device for a pneumatic control system, comprising a control element movable over a predetermined path, means operable by a pneumatic signal to move the said control element over the path from a first position to a second position, the energy for moving the control element being obtained from the pneumatic signal, a return spring against which the pneumatic signal operated means operates, a balance wheel coupled to the control element to maintain the said movement of the control element at a constant speed, a valve associated with the control element and communicating with a conduit for the passage of the pneumatic signal, and a connection between the valve and the control element such that the valve is actuated, for the passage of the signal, by the control element when the latter has moved from the first position to the second position.

According to another aspect of the present invention there is provided a timing device for a pneumatic control system, comprising a control element movable over a predetermined path, pneumatic drive means operable by a pneumatic signal and coupled to the control element to prevent movement of the said control element when deactuated and to permit a predetermined amount of movement of said control element when actuated by said pneumatic signal, a return spring against which the said drive means operates to effect movement thereof to the deactuated position, a balance wheel coupled to the control element to maintain the said movement of the control element at a constant speed, and a valve associated with the control element and communicating with a conduit for the passage of the pneumatic signal, a connection between the valve and the control element such that the valve is actuated for the passage of the signal by the control element when the latter has moved from a first position to a predetermined position.

Since a device according to the invention requires no external energy source other than the signal to be transmitted, a very simple construction is possible having a high accuracy in the time delay which may be adjusted within wide limits. In order to render the driving force for the balance wheel independent of the pressure of the pneumatic signal, the control element is driven, in one embodiment of the invention, by a spring-operated mechanism which stores energy supplied by the pneumatic signal and whose effect on the control element is triggered by the pneumatic signal. Where such a refinement is not required it is possible to drive the control device directly by a piston operated by the pneumatic signal.

In a particular construction, the control element is mounted on a disc which has a cut-out portion in which a stop pin runs. This latter is moved by a piston the movement of which is controlled by the pneumatic signal. Furthermore, the control element is a baffle which actuates a valve when the control disc, which has been released by the stop pin, has been rotated to a predetermined position. The actuation of the valve effects the transmission of the pneumatic signal. The position of the actuating device of the valve is adjustable with respect to the baffle. The actuation of the valve is advantageously effected pneumatically, and the acting pressure is furnished by the pneumatic input signal in that it is conveyed via a throttle to a nozzle which is closed in the actuating position by the baffle which is in the form of a plate. The pressure outlet for the valve actuation is reduced between the throttle and the nozzle.

Advantageously, the spring is loaded in such a device by the piston for the movement of the stop pin of the control disc operating against spring tension which moves it and consequently the control disc back into the original position after the pneumatic signal has ceased, the return movement simultaneously winding up the spring of the timing mechanism. In this way, each time that the pneumatic signal ceases, the spring of the timer is automatically wound up and is then ready for operation for the next signal.

It is not essential that the control element be a disc, it may, for example, be a linearly movable member.

In order that the invention may be more clearly understood, embodiments thereof will now be described by way of example with reference to the accompanying drawings, in which.

Figure 1:
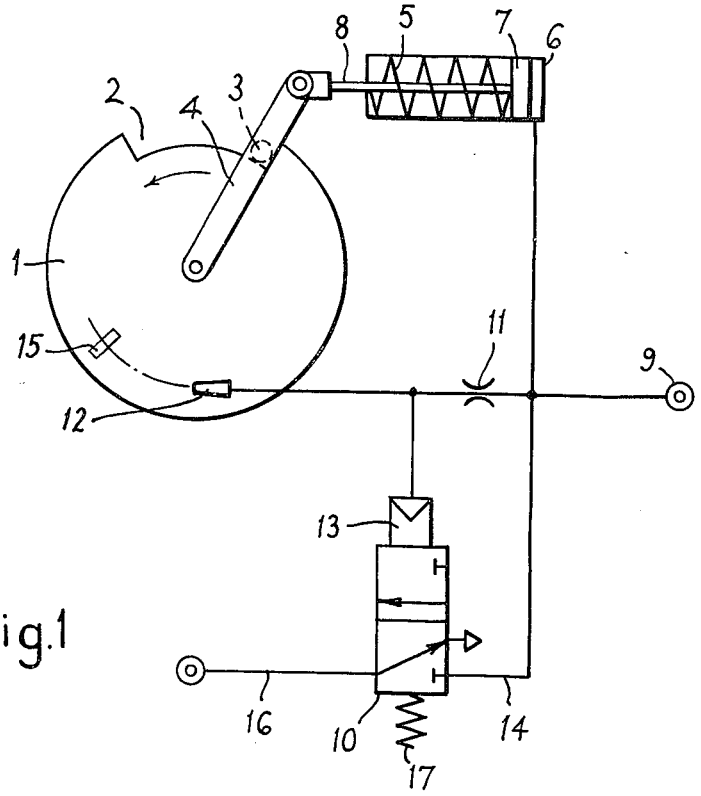
FIG. 1 shows a schematic view of the arrangement to illustrate the principles thereof.
Figure 2:
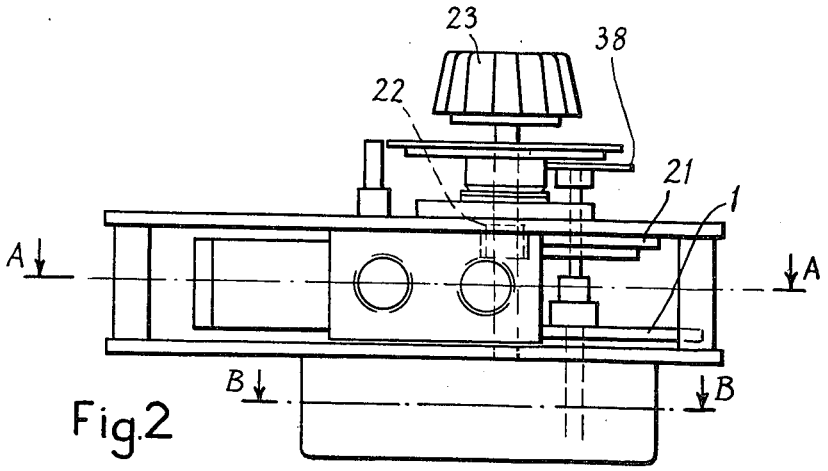
FIG. 2 shows a side view of the arrangement in practice.

Referring now to the drawings, in FIG. 1, the control element is in the form of a plate on a control disc 1. This control disc is rotated in one direction by a spring mechanism (not shown in FIG. 1), as will be explained in greater detail later, and is maintained at a constant speed of rotation in this direction by a balance wheel also now shown in FIG. 1. In the rest position, i.e., before pneumatic input signal occurs, the control disc 1 is arrested by a pin 3, located on a lever 4 freely rotatable about the axis of the control disc 1, which abuts a shoulder of a cut-out portion 2 of the disc and thus the latter, which tends to move under the influence of the spring mechanism in the direction of the arrow in an anti-clockwise direction, is held stationary. The lever 4 is held in its clockwise rotated position by an appropriately dimensioned spring 5 which pushes a piston 7, sliding in a cylinder 6, towards the right of the drawing and pulls the lever 4 towards the right by means of a rod 8. If the pneumatic signal, which can vary in pressure between 2 and 8 atmospheres, is now fed in at the input 9, it acts on the piston 7 in the cylinder 6 and the rod 8 is moved to the left, moving the lever 4 and the pin 3 in an anticlockwise direction and allowing the control disc 1 to rotate in an anticlockwise direction under the influence of the spring mechanism (not shown).

The input pressure fed in at 9 is also taken to a valve 10 and, via a throttle 11, to a nozzle 12. A pneumatic actuating device 13 for the valve 10 is connected between the throttle 11 and the nozzle 12 in the interconnecting conduit. As long as the nozzle 12 is open, the pressure on the pneumatic device 13 actuating the valve 10 is so low that it remains in a position which prevents the input signal fed in at 9 from being transmitted, an input conduit 14 of the valve thereby remaining closed. There is, furthermore, located on the control disc a plate 15 which is now brought near to the nozzle 12 by the movement of the control disc 1 which forms a part of the timing mechanism and, acts as a baffle plate for the nozzle, i.e., after a certain period of time has expired, the plate 15 closes the nozzle 12 and the pressure in the device 15 consequently rises so that the valve 10 is switched over and the passage from the conduit 14 to an output conduit 16, through which the pneumatic signal is to be forwarded, is opened.

The delay in the transmission of the signal is adjustable and may be altered by changing the distance between the nozzle 12 and the initial position of the plate 15, either by the plate 15 being movably arranged on the control disc or by the nozzle 12 being displaced over a circular path with respect to the plate 15, the conduit to which the nozzle 12 is connected also being flexibly arranged to allow for this movement.

As soon as the input signal fed in at 9 is removed, the valve 10 switches back by means of a built-in spring 17, and the output signal is removed from the conduit 16. The spring 5 pushes the piston 7 back and in this way the pin 3 which lies against the right hand stop formed by the cut-out portion 2 of the control disc 1 restores the control disc against the spring mechanism (not shown). This restoration action simultaneously causes the tensioning or winding up of the spring mechanism for rotating the control disc 1 in the anti-clockwise direction.

It is also possible for the valve 10 to be actuated purely mechanically, the plate 15 being constructed as an actuating member for this purpose. Pneumatic actuation offers, however, various advantages. It is also possible, to wind up the spring mechanism for rotating the disc 1, not by the return movement of the piston 7, but by a separate valve controlled, together with the valve 10, by a separate piston. However, with regard to cost, the embodiment illustrated offers advantages.

The valve 10 can be so adjusted that it switches from "open" to "closed" a certain time after the removal of the pneumatic signal.

Figure 3:
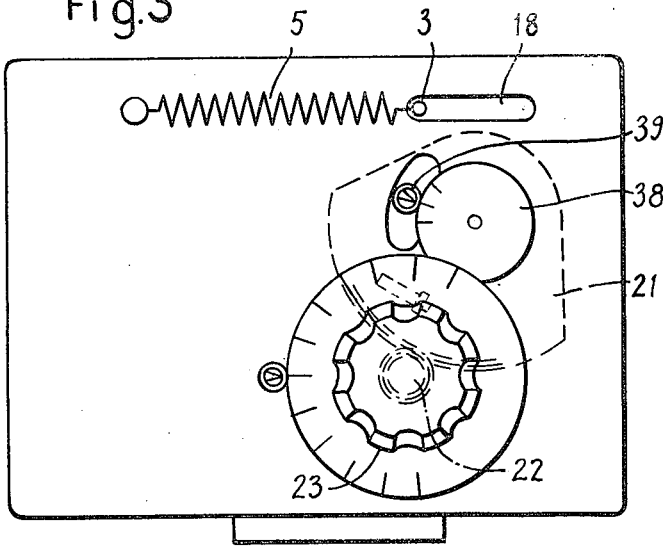
FIG. 3 shows a plan view of the device of FIG. 2.
Figure 4:
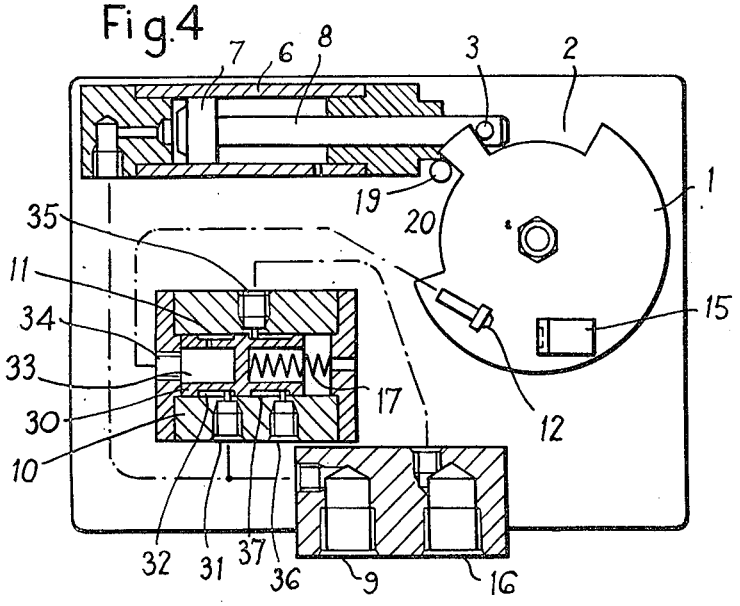
FIG. 4 shows a section along the line A—A of FIG. 2

FIGS. 2, 3, 4 and 5 show the construction of a practical timer according to the invention, and the reference numerals of FIG. 1 are used to designate the same components in these FIGS. The top right hand part of FIG. 4 shows the control disc 1, in the cut-out part 2 of which the pin 3 may be moved. It is not carried by the lever 4, as illustrated in FIG. 1, but directly by the rod 8 which is moved by the piston 7 sliding in the cylinder 6. The return spring 5 for the piston 7 is located on the outside of the upper plate or cover member (FIG. 3) and engages on the pin 3 which passes through a slot 18 therein. A stationary pin 19 (FIG. 4) slides relatively to a further arcuate cut-out portion 20 in the control disc 1 and serves to limit the movement of said control disc 1 which furthermore carries the deflector plate 15 for obturation of the nozzle 12.

Figure 5:
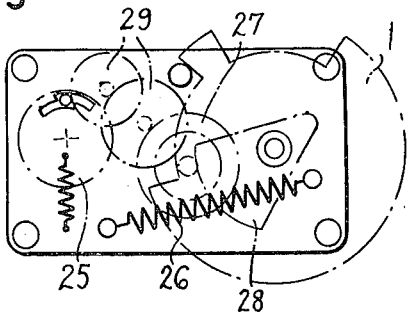
FIG. 5 shows a section along the line B—B of FIG. 2.

In order to set the desired delay time, the nozzle 12 is made displaceable with respect to the deflector plate 15. To this end, it is secured to a toothed segment 21 (FIG. 3), rotatable by a pinion 22, by rotating a preset knob 23 located above the cover plate of the apparatus. The delay time set may be read from a scale attached to the knob. The spring mechanism for rotating the control disc 1 in the clockwise direction as seen in FIGS. 4 and 5 is a tensioned spring 26 whose free end engages on the control disc 1. The control disc 1 acts on a balance wheel or flywheel 25 via a segment 28 arranged on a pin, and a gear train 29. In order to effect winding of the spring, a freewheel coupling 27 is interposed between the toothed segment 28 and the gear train 29. This freewheel coupling connects the segment to the balance wheel 25 after the spring 26 for returning the deflector plate 15 onto the nozzle 12 has been tensioned.

The spindle which carries the control disc 1 is extended beyond the upper plate and a disc 38 provided with a scale is secured thereto (FIG. 3). Moreover, an indicator 39 which projects through a sector-shaped cut-out portion in the upper plate up to the height of the disc 38, is secured to the toothed segment 21 which carries the nozzle 12. In this way, the scale on the disc 38 indicates the position of the nozzle 12 with respect to the deflector plate 15 and consequently the time which has passed or the time up to the switching over of the pneumatic signal.

The valve 10 (FIG. 4), which effects the control of the pneumatic signal, contains a control piston 30 acting against the spring 17, and this piston carries out all control functions at the same time. To this end, the pneumatic input 9 of the device is firstly connected via a bore 31 to an annular conduit 32 formed in the piston. Said annular conduit is connected to a bore 33 inside the piston 30, via the nozzle 11 which represents the throttle between the input 9 and the deflector nozzle 12 (FIG. 1), said bore being connected through an opening 34 to the nozzle 12. By closing the nozzle 12, the total pressure of the pneumatic signal is effective inside the bore 33 and thus the piston 30 moves towards the right against the effect of the spring 17. The annular conduit 32 arrives in such a position that now the input signal is transmitted via the bore 35 to the output 16. In the position shown in FIG. 4, wherein there is no connection to the output, said output is connected to the atmosphere via a bore 36 and an annular conduit 37 in the piston 30.

Finally, the mode of operation of the device will once again be explained with reference to the embodiment according to FIGS. 2 to 5. These Figs. show the state when there is no signal at the input 9. The spring 5 has moved the piston 7 in the cylinder 6 towards the left of the drawing into the original position, through the cooperation of the pin 3 and the rod 8. In this way, the control disc 1 has also been brought into its original position and it has thereby tensioned the spring 26 which is of appropriate strength in comparison with the spring 5. This tensioning movement is made possible by the freewheel coupling 27 permitting the control disc 1 to rotate in the tensioning direction, without repercussion on the gear train 29 and the balance wheel 25 connected in series therewith. The valve 10 is located in such a position that the output 16 is connected to the atmosphere via the bore 36 and the throttle 11 is interposed between the input 9 and the nozzle 12. If a pneumatic signal 9 is now fed into the timer, this signal will firstly act on the piston 7 which moves the rod 8 and the transverse pin 3 towards the right of the drawing. The control disc 1 is released and moves in a clockwise direction under the action of the spring 26. The speed of this movement is governed by the balance wheel 25 which is driven via the freewheel coupling 27 and the gear train 29. The valve 10 remains in the position shown because the air entering via the throttle 11 into the bore 33 of the valve piston can flow through the nozzle 12 unhindered. After a period of time which is prescribed by the position of the nozzle in relation to the deflector plate 15 on the control disc 1 and which may be adjusted by rotating the knob 23, the deflector plate 15 closes the nozzle 12. Pressure now builds up in the chamber 33 by the inflowing air, which pressure shifts the piston towards the right of the drawing against the action of the spring 17. In this way, the annular conduit 32 forms a connection between bore 31 and bore 35 and the signal fed in at 9 is transmitted to the output 16 after a period of time set by the preset knob 23. In this way, the position of the nozzle 12 with respect to the deflector plate 15 may be read from a scale located on the disc 38 which is securely connected to the control disc 1 and the indicator 39 which is connected to the toothed segment 21 on which the nozzle 12 is located.

When the input pulse 9 has been removed, it is not only the piston 7 of the cylinder 6 which is moved back into the original position by the spring 5 but also the piston 30 of the valve 10 by the spring 17. The output 16 is thus connected to atmosphere via the bore 36 and the annular conduit 37 and the control disc 1 is rotated back into its original position. In this way, the spring 26 which is of suitable strength in relation to that of the spring 5, is tensioned. This winding up movement is made free from influence by the balance wheel 25 and the free wheel coupling 27. The apparatus is then ready for the next operation.

It may thus be seen that the supply of power to the mechanism to provide the delay between the time when the signal at the input 9 appears at the output 16 is obtained entirely from the signal itself, since energy from the pneumatic signal at 9 is first stored in the spring 5, and then transferred to and stored in the spring 26, which is brought into tension upon the release of the spring 5 from compression, by the removal of the pneumatic signal. The energy stored in the spring 26 under tension is released under the control of the balance wheel 25 via the flywheel coupling 27 and the gear train 29 when the pneumatic signal is again applied.

Figure 6:
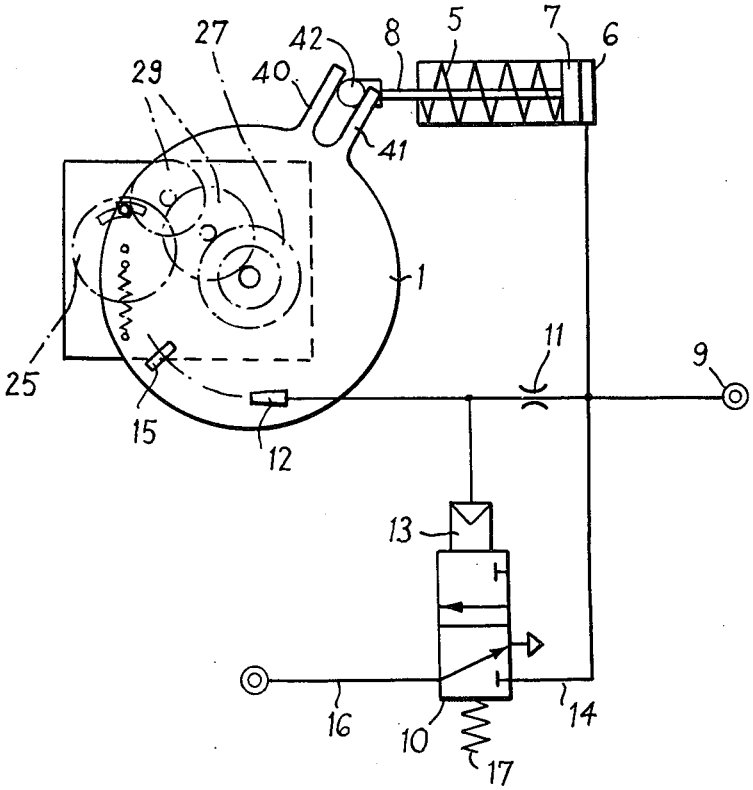
FIG. 6 shows a side view of an alternative embodiment.

Referring to FIG. 6, where the same reference numerals are used for similar parts to those already described with reference to FIGS. 1 to 5, the control disc 1 is shown with radially extending fingers 40 and 41 between which a pin 42 carried by the rod 8 passes. The balance wheel 25 is driven from the spindle of the disc 1 via a freewheel coupling 27 and two gear wheels 29. The freewheel coupling is so designed that the return movement of the disc 1 in the clockwise direction can take place without hinderance by the balance wheel 25.

In operation, the receipt of an input pneumatic signal at the terminal 9, results in the leftward movement of the piston 7 and the rod 8 and the compression of the spring 5. The pin 42 on the rod 8 rides in the space between the fingers 40 and 41 and causes the control disc 1 to be rotated in an anti-clockwise direction resulting in the plate 15 baffling the nozzle 12 in the way previously described and the operation of the valve 10. The speed of rotation of the disc 1 is maintained at a constant value by means of the balance wheel 25, so that the time taken by the plate 15 to close the nozzle 12 is determined by the distance over which it travels, as in the embodiment of FIGS. 1 – 5.

Upon the removal of the pneumatic signal from the input 9, the spring 5 restores the piston 7 and the rightward movement of the rod 8 and the pin 42 sliding in the slot between the fingers 40 and 41 causes the disc 1 to be rotated in a clockwise direction and restored to the position shown, the freewheel coupling 27 permits the disc 1 to be restored without affecting the balance wheel 25.

It may thus be seen that in this embodiment also the power for the operation of the delay mechanism is obtained from the pneumatic signal to be delayed.

Of course, other constructions and modifications of the arrangements described herein may be made within the scope of the present invention.

For example, although in the embodiments described the control element is a plate mounted on a disc whose rotational movement is maintained at a substantially constant speed by being coupled to a balance wheel, the control element can be mounted on a linearly movable member whose movement is maintained at a substantially constant speed by being coupled to a balance wheel.

We claim:

1. A timing device for a pneumatic control system of the type comprising a conduit (9) for the passage of successive pneumatic signals said signals being constituted by changes in pneumatic pressure in said conduit, and a valve (10) controlling the passage of said signals through said conduit, said timing device comprising, a control element (15) movable over a predetermined path, a control spring (26) coupled to said control element for moving said control element over said path from a first position to a second position, a housing (6) connected to said conduit, said housing containing pressure-responsive means (7) movable in response to pneumatic pressure, coupling means (1, 3) coupling said pressure-responsive means to said control element so that when said pressure-responsive means is supplied with energy by a signal received through said conduit, energy is stored in said control spring, a return spring (5) against which said pressure-responsive means operates, a balance wheel (25) coupled to said control element to maintain the movement of said control element at a constant speed, means (12) connected between said valve and control element and through which said valve is actuated by said control element to permit passage of the signal, when said control element is moved from the first position to the second position, said coupling means comprising a locking member (3) for releasing or locking said control element in response to the pneumatic signal received through said conduit.

2. A timing device for a pneumatic control system of the type comprising a conduit (9) for the passage of successive pneumatic signals said signals being constituted by changes in pneumatic pressure in said conduit, and a valve (10) controlling the passage of said signals through said conduit, said timing device comprising, a control element (15) movable over a predetermined path, a control spring (26) coupled to said control element for moving said control element over said path from a first position to a second position, a housing (6) connected to said conduit, said housing containing pressure-responsive means (7) movable in response to pneumatic pressure, coupling means (1,3) coupling said pressure-responsive means to said control element, a return spring (5) against which said pressure-responsive means operates, a balance wheel (25) coupled to said control element to maintain the movement of said control element at a constant speed, means (12) connected between said valve and control element and through which said valve is actuated by said control element to permit passage of the signal, when said control element is moved from the first position to the second position, said coupling means comprising a locking member (3) moved by said pressure-responsive means (7) for releasing or locking said control element in response to the pneumatic signal received through said conduit, said locking member coupling the pressure-responsive means (7) to said control element for moving said control element (15) and said control spring (26) coupled to the control element back from the second position to the first position when said pressure-responsive means is moved by its return spring (5).

3. A timing device according to claim 2 in which said coupling means comprises a rotatable control disc, said control disc defining a cut-out portion, said pressure-responsive means comprises a movable piston, and said locking member comprises a stop pin coupled to said piston, movable in response to movement thereof and positioned to move in the said cut-out portion, said valve actuating means comprising a valve actuating member adjustably positioned relative to said control element and so arranged that said valve is actuable by said control element via said actuating member upon rotation of said control disc by a predetermined amount when released by said stop pin upon the said movement of said piston, thereby permitting onward transmission of the pneumatic signal.

4. A timing device according to claim 3, wherein said valve actuating member comprises a nozzle, said control element is constituted by a baffle plate, which is moved toward and away from said nozzle by rotation of said disc, said valve is pressure actuated through a pneumatic connection between said nozzle and said valve, and the pneumatic signal received through the conduit is supplied to said nozzle through a throttle, so that the pressure acting on said valve depends on the position of said baffle plate relative to said nozzle.

5. A timing device according to claim 4, in which said control spring is coupled to said control disc for operating said control element, wherein the piston is arranged to act against said return spring and wherein said return spring is connected to return said control element to its first position in the absence of a pneumatic signal, the said return movement storing energy in the said spring for operating said control element.

6. A timing device according to claim 5, including a freewheel coupled between said balance wheel and said control disc and control spring whereby during said return movement the control disc and control spring are free of the said balance wheel.

* * * * *